US011970855B2

(12) United States Patent
Zemler et al.

(10) Patent No.: US 11,970,855 B2
(45) **Date of Patent: *Apr. 30, 2024**

(54) PROCESS FOR ASSEMBLING A FIRE- , SMOKE- , SOUND- AND/OR WATER-PROOF SYSTEM WITHIN A DYNAMIC CURTAIN WALL FAÇADE

(71) Applicant: Hilti Aktiengesellschaft, Schaan (LI)

(72) Inventors: Matthew Zemler, Corinth, TX (US); Mario Paetow, Landsberg am Lech (DE); Arndt Andresen, Lake Dallas, TX (US)

(73) Assignee: Hilti Aktiengesellschaft, Schaan (LI)

( * ) Notice: Subject to any disclaimer, the term of this patent is extended or adjusted under 35 U.S.C. 154(b) by 171 days.

This patent is subject to a terminal disclaimer.

(21) Appl. No.: 17/438,457

(22) PCT Filed: Mar. 2, 2020

(86) PCT No.: PCT/EP2020/055440
§ 371 (c)(1),
(2) Date: Sep. 12, 2021

(87) PCT Pub. No.: WO2020/182518
PCT Pub. Date: Sep. 17, 2020

(65) Prior Publication Data

US 2022/0127849 A1 Apr. 28, 2022

Related U.S. Application Data

(63) Continuation of application No. 16/353,856, filed on Mar. 14, 2019, now Pat. No. 10,538,915.

(51) Int. Cl.

| | |
|---|---|
| ***E04B 2/96*** | (2006.01) |
| ***E04B 1/68*** | (2006.01) |
| ***E04B 2/92*** | (2006.01) |

(52) U.S. Cl.
CPC ..... *E04B 2/96* (2013.01); *E04B 1/68* (2013.01); *E04B 2/92* (2013.01)

(58) Field of Classification Search
CPC ..... E04B 2/96; E04B 1/68; E04B 2/92; E04B 1/948
See application file for complete search history.

(56) References Cited

U.S. PATENT DOCUMENTS

| | | | |
|---|---|---|---|
| 3,786,604 | A | 1/1974 | Kramer |
| 4,449,341 | A | 5/1984 | Taglianetti et al. |

(Continued)

FOREIGN PATENT DOCUMENTS

| | | |
|---|---|---|
| CA | 2997202 | 3/2017 |
| CN | 109339308 | 2/2019 |

(Continued)

OTHER PUBLICATIONS

International Search Report dated May 29, 2020 in PCT/EP2020/055440, 3 pages.

(Continued)

*Primary Examiner* — Patrick J Maestri
(74) *Attorney, Agent, or Firm* — Grüneberg and Myers PLLC

(57) ABSTRACT

Described is a process for assembling a fire-, smoke-, sound- and/or water-proof system within a dynamic curtain wall façade using a tubular sealing element comprising a thermally resistant flexible foam material for insulating and sealing.

15 Claims, 1 Drawing Sheet

(56) References Cited

U.S. PATENT DOCUMENTS

| | | | | |
|---|---|---|---|---|
| 4,866,898 | A * | 9/1989 | LaRoche | E04B 1/6804 52/396.01 |
| 5,502,937 | A | 4/1996 | Wilson | |
| 7,424,793 | B1 | 9/2008 | Shriver | |
| 7,856,775 | B2 | 12/2010 | Stahl, Jr. | |
| 8,365,495 | B1 * | 2/2013 | Witherspoon | E04B 1/98 52/396.01 |
| 8,671,645 | B1 | 3/2014 | Shriver | |
| 8,683,763 | B2 | 4/2014 | Shriver | |
| 8,782,977 | B2 | 7/2014 | Burgess | |
| 9,365,960 | B2 | 6/2016 | Craig | |
| 10,138,629 | B2 | 11/2018 | Schulz-Hanke et al. | |
| 10,221,565 | B2 | 3/2019 | Boucher et al. | |
| 10,280,679 | B2 | 5/2019 | Al Kassas | |
| 10,407,911 | B2 | 9/2019 | Fenske | |
| 10,415,239 | B2 | 9/2019 | Schulz-Hanke et al. | |
| 10,624,395 | B2 | 4/2020 | Craig | |
| 11,035,121 | B2 | 6/2021 | Klein et al. | |
| 2007/0204540 | A1 | 9/2007 | Stahl, Sr. et al. | |
| 2012/0180414 | A1 | 7/2012 | Burgess | |
| 2012/0266362 | A1 | 10/2012 | Craig | |
| 2013/0097948 | A1 | 4/2013 | Burgess | |
| 2016/0278441 | A1 | 9/2016 | Craig | |
| 2016/0356034 | A1 | 12/2016 | Andresen | |
| 2017/0145685 | A1 | 5/2017 | Andresen | |
| 2017/0183863 | A1 | 6/2017 | Foerg et al. | |
| 2017/0370097 | A1 | 12/2017 | Schulz-Hanke et al. | |
| 2018/0245341 | A1 | 8/2018 | Boucher et al. | |
| 2018/0334799 | A1 * | 11/2018 | Andresen | E04B 2/96 |
| 2020/0205482 | A1 | 7/2020 | Craig | |
| 2020/0332525 | A1 | 10/2020 | Klein et al. | |

FOREIGN PATENT DOCUMENTS

| | | |
|---|---|---|
| DE | 23 44 429 | 3/1975 |
| DE | 27 40 972 | 3/1979 |
| DE | 41 42 892 | 5/1993 |
| DE | 196 35 466 | 3/1998 |
| EP | 0 426 187 | 5/1991 |
| EP | 3 034 709 | 6/2016 |
| EP | 3 056 633 | 8/2016 |
| EP | 3 141 138 | 3/2017 |
| EP | 3 246 480 | 11/2017 |
| JP | S59-122651 | 7/1984 |
| JP | H08-85189 | 4/1996 |
| JP | H08-170393 | 7/1996 |
| JP | 2017-190575 | 10/2017 |
| JP | 2017-218738 | 12/2017 |
| KR | 2019016060 | 2/2019 |
| WO | 2012/119479 | 9/2012 |
| WO | 2016/200036 | 12/2016 |

OTHER PUBLICATIONS

Written Opinion dated May 29, 2020 in PCT/EP2020/055440, 5 pages.
U.S. Appl. No. 17/438,451, filed Sep. 12, 2021, Zemler et al.
U.S. Appl. No. 17/438,459, filed Sep. 12, 2021, Ober et al.

* cited by examiner

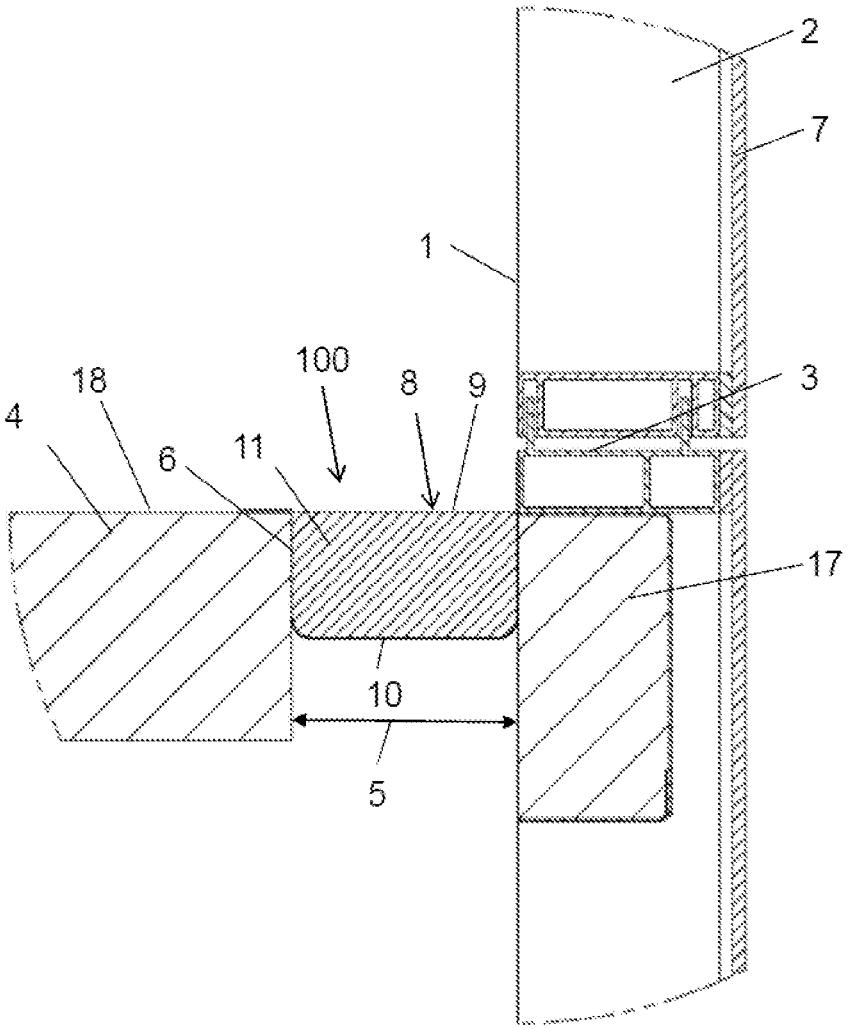
2
7
1
100
8
9
3
18
4
6
11
17
10
5

PROCESS FOR ASSEMBLING A FIRE- , SMOKE- , SOUND- AND/OR WATER-PROOF SYSTEM WITHIN A DYNAMIC CURTAIN WALL FAÇADE

CROSS-REFERENCE TO RELATED APPLICATIONS

This application is the National Stage entry under § 371 of International Application No. PCT/EP2020/055440, filed on Mar. 2, 2020, and which claims the benefit of priority to U.S. application Ser. No. 16/353,856, filed on Mar. 14, 2019. The content of each of these applications is hereby incorporated by reference in its entirety.

BACKGROUND OF THE INVENTION

Field of the Invention

The present invention relates to the field of constructions, assemblies and systems designed to seal a safing slot area defined between a curtain wall and the individual floors of a building, in particular for sealing the safing slot with regard to fire, smoke, noise and, if applicable, with regard to water. In particular, the present invention relates to a process for assembling a fire-, smoke-, sound- and/or water-proof system within a stick build exterior dynamic curtain wall façade or in a curtain wall assembly from unitized panels.

Description of Related Art

Curtain walls are generally used and applied in modern building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

Due to the recent developments on the building construction market, the outer façade of a building (curtain wall façade) will be either assembled piece by piece directly on the jobsite, or assembled using pre-fabricated unitized panels, thereby requiring at the same time sufficient fire-, smoke-, sound- and/or water-stopping in the created safing slot. A process for installing sufficient fire-, smoke-, sound- and/or water-stopping is highly desirable that is quick and clean when a stick build curtain wall façade or unitized panel façade is assembled. Further, this process should ensure the quality of fire-, smoke-, sound- and/or water-protection that is required according to various standards. In particular, this process should be applicable for all types of curtain wall structures, such as curtain wall structures having a common curtain wall design including a foil-faced curtain wall insulation, a steel back pan design or which include glass, especially vision glass extending to the finished floor level below.

The gap between the floor and the interior wall surface of a curtain wall defines a safing slot, also referred to as perimeter slab edge (void) or perimeter joint, extending between the interior wall surface of the curtain wall construction and the outer edge of the floor. This safing slot is essential to slow the passage of fire and combustion gases between floors. Therefore, it is of great importance to improve fire-, smoke-, sound- and/or water-stopping at the safing slot in order to keep heat, smoke, flames, noise and/or water from spreading from one floor to an adjacent floor.

Due to the increasingly strict requirements regarding fire-resistance as well as horizontal and vertical movement, there is a need for a dynamic, thermally and acoustically insulating and sealing system that can be easily installed in a curtain wall structure and is capable of meeting or exceeding existing fire test and building code requirements and standards including existing exceptions and which can be easily installed and minimizes the materials used on the jobsite. In particular, there is a need for a system that when installed during the building up the curtain wall façade, prevents the spread of fire when vision glass of a curtain wall structure extends to the finished floor level below even when exposed to certain movements (complying with the requirements for a class IV movement).

Moreover, there is a need for systems that improve fire-resistance as well as sound-resistance, and have at the same time enhanced water-stopping properties and can be easily integrated during installation of the curtain wall structure. In particular, there is a need for a process to install a dynamic, fire-resistance-rated thermally insulating and sealing systems within a dynamic curtain wall façade that additionally address water infiltration as well as inhibition of water transfer within the building structures and enhance the water-tightness of the safing slot sealing system.

In view of the above, it is an object of the present invention to provide a process for assembling a fire-, smoke-, sound- and/or water-proof system within a stick build exterior dynamic curtain wall façade or in a curtain wall assembly from unitized panels.

Further, it is an object of the present invention to provide a process for installing a system within a curtain wall façade that is full-scale ASTM E 2307 as well as ASTM E 1399 tested, to address the known code exception, to avoid letters and engineering judgments, and to secure and provide defined/tested architectural detail for this application, in particular, by providing a tested system for fire—as well as movement-safe architectural compartmentation and which makes it easier for the installers to build up the curtain wall façade on the jobsite.

These and other objectives as they will become apparent from the ensuing description of the invention are solved by the present invention as described herein. Portions of the disclosure pertain to preferred embodiments.

SUMMARY OF THE INVENTION

In one aspect, the present invention provides a process for assembling a fire-, smoke-, sound- and/or water-proof system within a stick build exterior dynamic curtain wall façade or in a curtain wall assembly from unitized panels. In particular, it is an aspect of the present invention to provide such a process comprising the following steps:

- assembling a framing structure by attaching anchoring brackets to horizontal and vertical framing members and to the concrete and steel members of the curtain wall façade to the building structure or to upper locations of the vertical framing member ready for mounting the finished unitized panel to the building structure;
- providing the appropriate water gasket seals to the framing members to seal the framing structure and building structure from water intrusion, wind, air, temperature;
- positioning a tubular sealing element comprising a thermally resistant flexible foam material for insulating and sealing, in the safing slot extending between an interior wall surface of the curtain wall façade and an outer edge of the floor of the building structure, wherein the tubular sealing element includes:

a) a bottom side cover;

b) a top side cover;

whereby the top side cover is connected at two positions, spatially disposed from each other, to the bottom side cover; and whereby the bottom side cover and the top side cover surround the thermally resistant flexible foam material;

c) a first connection area for attaching the tubular sealing element to the interior wall surface of the curtain wall construction; and d) a second connection area for attaching the tubular sealing element to the outer edge of the floor; and fixing the first connection area and the second connection area of the tubular sealing element to the curtain wall façade and to the building structure to achieve a firm seal of the safing slot.

In another aspect, the present invention provides a building construction having a stick build exterior dynamic curtain wall façade or a curtain wall assembly from unitized panels, which comprises a fire-, smoke-, sound- and/or water-proof system installed according to the process of the invention.

BRIEF DESCRIPTION OF THE FIGURE

The subject matter of the present invention is further described in more detail by reference to the following FIGURE:

The FIGURE shows a side cross-sectional view of the fire-, smoke-, sound- and/or water-proof system in its final installation within an exterior dynamic curtain wall façade, wherein the vision glass extends to the finished floor level below.

DETAILED DESCRIPTION OF THE INVENTION

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" or "curtain wall façade" in context with the present invention refers to a wall structure defined by an interior wall surface including one or more framing members and at least one floor spatially disposed from the interior wall surface of the curtain wall construction. In particular, this refers to curtain a wall structure having a common curtain wall design including foil-faced curtain wall insulation, a steel back pan design or which includes glass, especially vision glass extending to the finished floor level below.

The term "safing slot" in context with the present invention refers to the gap between a floor and the interior wall surface of the curtain wall construction as defined above; it is also referred to as "perimeter slab edge" or "perimeter joint", extending between the interior wall surface of the curtain wall construction and the outer edge of the floor.

The term "interior wall surface" in context with the present invention refers to the inner facing surface of the curtain wall construction as defined above, for example to the inner facing surface of the infilled vision glass and the inner facing surface of the framing members.

The term "connection area", also considered as an "attachment area", in context with the present invention refers to from the main body of the tubular sealing element outwardly projecting flexible wings or tabs, which constitute of parts of the bottom side cover and the top side cover (wing-like), which surround the foam material (main body). The connection areas are preferably positioned at upper corners of the main body in an area where the bottom side cover is connected to the top side cover.

The term "enhancing water-stopping properties" in context with the present invention refers to the prevention of water infiltration as well as to inhibition of water transfer within the building structures and to enhancing water-tightness of the safing slot sealing system.

The process for assembling a fire-, smoke-, sound- and/or water-proof system according to the present invention encompasses the use of one tubular sealing element which provides when installed a system that addresses the code exception and meets the requirements of standard method ASTM E 2307 and complies with the requirements of standard method ASTM E 1399, and is described in the following:

According to the present invention, the process for assembling a fire-, smoke-, sound- and/or water-proof system within a stick build exterior dynamic curtain wall façade or in a curtain wall assembly from unitized panels, comprises the following steps:

assembling a framing structure by attaching anchoring brackets to horizontal and vertical framing members and to the concrete and steel members of the curtain wall façade to the building structure or to upper locations of the vertical framing member ready for mounting the finished unitized panel to the building structure;

providing the appropriate water gasket seals to the framing members to seal the framing structure and building structure from water intrusion, wind, air, temperature;

positioning a tubular sealing element comprising a thermally resistant flexible foam material for insulating and sealing, in the safing slot extending between an interior wall surface of the curtain wall façade and an outer edge of the floor of the building structure, wherein the tubular sealing element includes:

a) a bottom side cover;

b) a top side cover;

whereby the top side cover is connected at two positions, spatially disposed from each other, to the bottom side cover; and whereby the bottom side cover and the top side cover surround the thermally resistant flexible foam material;

c) a first connection area for attaching the tubular sealing element to the interior wall surface of the curtain wall construction; and d) a second connection area for attaching the tubular sealing element to the outer edge of the floor; and fixing the first connection area and the second connection area of the tubular sealing element to the curtain wall façade and to the building structure to achieve a firm seal of the safing slot.

In particular, in a first step the framing structure for the curtain wall façade or the framing structure of the unitized panel is assembled. Anchoring brackets are attached to horizontal and vertical framing members and to the concrete and steel members of the façade to the building structure or to upper locations of the vertical framing member ready for mounting the finished unitized panel to the building structure. Usually, rectangular aluminum tubing mullions and transoms are used according to the curtain wall system manufacturer's guidelines that will manufacture the elements for a stick built curtain wall façade or manufacture the unitized panels.

In a second step, appropriate water gasket seals are provided to seal the framing structure and building structure from water intrusion, wind, air, temperature.

In a third step, a tubular sealing element comprising a thermally resistant flexible foam material for insulating and sealing, is positioned in the safing slot extending between an interior wall surface of the curtain wall façade and an outer edge of the floor of the building structure, wherein the tubular sealing element includes a bottom side cover; a top side cover; whereby the top side cover is connected at two positions, spatially disposed from each other, to the bottom side cover; and whereby the bottom side cover and the top side cover surround the thermally resistant flexible foam material; a first connection area for attaching the tubular sealing element to the interior wall surface of the curtain wall construction; and a second connection area for attaching the tubular sealing element to the outer edge of the floor.

In a fourth step, the first connection area and the second connection area of the tubular sealing element are fixed to the curtain wall façade and to the building structure to achieve a firm seal of the safing slot.

It is preferred that the first connection area for attaching the tubular sealing element to the interior wall surface of the curtain wall construction and the second connection area for attaching the tubular sealing element to the outer edge of the floor, each constitute of parts of the bottom side cover and the top side cover, which surround the foam material. Preferably the connection areas, also referred to as flexible wings or tabs, projecting outwardly from the main body (wing-like) of the tubular sealing element. The connection areas are preferably positioned at upper corners of the main body in an area where the bottom side cover is connected to the top side cover allowing for an easy positioning within the safing slot. Most preferably, the connection areas are positioned at upper corners of the tubular sealing element having approximately squared cross-section.

The tubular sealing element is preferably placed into the safing slot such that the top side cover is flush with the top surface of the concrete floor.

In a preferred embodiment of the process according to the present invention, a lower side of the first connection area of the tubular sealing element is fixed to the interior wall surface of the curtain wall façade, and a lower side of the second connection area of the tubular sealing element is fixed to the top surface of the floor, thereby allowing to easily mount the fire-, smoke-, sound- and/or water-proof system.

In a preferred embodiment, the tubular sealing element is placed into the safing slot such that the top side cover is flush with the top surface of the concrete floor. The tubular sealing element can be inserted in the safing slot from above or below the floor, preferably is inserted from above the floor, and the easily fixed to ensure complete seal of the safing slot.

In a preferred embodiment, the tubular sealing element further comprises an adhesive layer positioned at the first connection area and/or the second connection area, wherein the adhesive layer may be positioned on an upper or on a lower side of the connection areas. Most preferred an adhesive layer is positioned on the lower side of the connection areas. It is preferred, that the adhesive layer is a hot-melt adhesive, a butyl sealing, a double sided adhesive or a self-adhesive layer. In a preferred embodiment of the dynamic, thermally insulating and sealing system according to the present invention, the adhesive layer, including an adhesive backer, is a hot-melt self-adhesive layer. In a most preferred embodiment, the adhesive baker is a silicone paper.

Hence, the process according to the present invention comprises fixing the first connection area and the second connection area of the tubular sealing element using an adhesive layer including adhesive backers.

In a preferred embodiment of the process according to the present invention, fixing the first connection area using an adhesive layer comprises removal of adhesive backers and bonding of the adhesive layer to the interior wall surface of the curtain wall façade, and wherein fixing the second connection area using an adhesive layer comprises removal of adhesive backers and bonding of the adhesive layer to the top surface of the floor.

In a preferred embodiment, the bottom side cover of the tubular sealing element used in the process, is a bottom side laminate. This laminate may comprise at least two layers, preferably comprises three layers. In particular, the bottom side laminate comprises a plastic foil layer, preferably comprising polyethylene, polypropylene or the like, wherein a mesh layer is laminated between the plastic foil layers, most preferably between two polyethylene foil layers. In a most preferred embodiment, the bottom side laminate is a laminate having a glass fibre mesh layer laminated between two polyethylene layers.

Alternatively, the bottom side cover may also consist of one or more layers, such as layers or reinforced layers from a woven material, a woven fabric, a foil, a reinforced fiber fabric or the like, or a combination therefrom.

In a preferred embodiment, the top side cover of the tubular sealing element used in the process, is a top side laminate. This laminate may comprise at least two layers, preferably comprises three layers. In particular, the top side laminate comprises an aluminum layer, a plastic foil layer, preferably comprising polyethylene, polypropylene or the like, and a mesh layer. Most preferably, the top side laminate is constituted of a reinforced aluminum layer with a polyethylene backing. Alternatively, the topside cover may also consist of one or more layers, such as layers or reinforced layers from a woven material, a woven fabric, a foil, a reinforced fiber fabric or the like, or a combination therefrom.

The bottom side cover and the top side cover can be of different or of the same materials depending on the material properties and intended function. However, it is preferred that the bottom side cover and the top side cover are of different materials.

In a preferred embodiment of the process according to the present invention, the mesh layer of the bottom side laminate and/or the mesh layer of the top side laminate the tubular sealing element used in the process is made of a glass fiber material or a ceramic fiber material. The fiber mesh is used to retain the foam material in place and enhance stability of the system as well as stabilizes the seal once the thermally resistant flexible foam material has been in contact with fire. The mesh layer of the bottom side laminate and/or the mesh layer of the top side laminate can be laminated between two layers of combustible foil for instance. Further, the mesh layer might be fixed or unfixed. Preferably, the mesh size of the mesh layer of the top side laminate differs from the mesh size of the mesh layer of the bottom side laminate. Preferably, the mesh sizes range in between of about 2 mm×2 mm to about 10 mm×10 mm, more preferably are about 5 mm×5 mm.

In a preferred embodiment, the thermally resistant flexible foam material of the tubular sealing element used, is an intumescent, open-celled foam material comprising fire-protective additives having improved hydrophobic properties. Preferably, the intumescent, open-celled foam material, is a foam material based on polyurethane. It is preferred, that the thermally resistant flexible foam material has a density in uncompressed state of 90 kg/m$^3$.

According to the invention, the cross-sectional form of the tubular sealing element used in the process is generally of rectangular, trapezoidal, circular shape or U-shaped. Preferably, the cross-sectional form of the tubular sealing element is rectangular shaped. The tubular sealing element can easily be produced with different widths with regard to the cross-sectional form, for application in different safing slot widths, for example the tubular sealing element can be produced in a width of about 3.54 inches (about 90 mm) that is used for a safing slot width of 1.5 inches to 3 inches (38.1 mm-76.2 mm), a width of about 4.53 inches (about 115 mm) that is used for a safing slot width of 2 inches to 4 inches (50.8 mm to 101.6 mm), and further a width of about 5.55 inches (about 141 mm) that is used for a safing slot width of 3 inches to 5 inches (76.2 mm to 127 mm). These different sizes ease installation in that that the tubular sealing element does not need to be force-compressed into the safing slot. In an alternative embodiment with the tubular sealing element having a generally trapezoidal cross-sectional shape, a larger side of the tubular sealing element can be positioned on the curtain wall side and a smaller side of the tubular sealing element might be positioned on the floor side. For example, the tubular sealing element might have a thickness of 3.5 inches on the curtain wall side and a thickness of 2.375 inches on the floor side thereby enhancing fire-stopping. Any other dimensions for a trapezoidal shape are also feasible.

In a particular embodiment of tubular sealing element used, the bottom side cover of the tubular sealing element comprises openings or perforations for water transfer from an inner side of the tubular sealing element to the outside in case where water has been infiltrated into the building structures and hence into the sealing element, whereas the top side cover preferably does not contain perforations or openings to prevent water entry from the top side by for example rain. In an alternative embodiment, the outer surface of the top side cover is convex.

The process of the present invention, may comprise in a fourth optional step applying a watertight seal at each seam, splice or butt joint between adjacent tubular sealing elements and around each bracket just in this location to enhances the water-stopping properties of the fire-, smoke-, sound- and/or water-proof system. In particular, the watertight seal can be applied with a 2 mm wet thickness over any seams and overlapping a min. of 1 inch onto tubular sealing elements, the adjacent curtain wall façade and concrete floor slab assembly. Preferably, the watertight seal is in the form of an emulsion, spray, coating, foam, paint or mastic. There is no need for applying the sealant across the whole safing slot area.

In a fifth step, the process for assembling a fire-, smoke-, sound- and/or water-proof system within a stick build exterior dynamic curtain wall façade or in a curtain wall assembly from unitized panels is completed by installing an architectural cover, a steel plate, or a kneewall to completely cover the safing slot.

It is also possible, in order to enhance sealing, that an additional tubular sealing element is installed from the bottom side of the safing slot thereby covering the brackets and protecting them from fire, smoke, wind and water intrusion.

The fire-, smoke-, sound- and/or water-proof system is preferably for installation within a building construction defined by an interior wall surface including one or more framing members and at least one floor spatially disposed from the interior wall surface of the curtain wall construction defining the safing slot extending between the interior wall surface of the curtain wall construction and an outer edge of the floor. In particular, the building construction can comprise a curtain wall construction that is comprised of a vision glass infill and at least one vertical and at least one horizontal metal framing member. Alternatively, the building construction can comprise a curtain wall construction having a common curtain wall design including foil-faced curtain wall insulation or a steel back pan design.

The fire-, smoke-, sound- and/or water-proof system can be used in a stick-built exterior dynamic curtain wall façade or used in assembling a unitized panel for use within an exterior dynamic curtain wall assembly.

The installed fire-, smoke-, sound- and/or water-proof system within a stick build exterior dynamic curtain wall façade or in a curtain wall assembly from unitized panels, when used for acoustically insulating and sealing of a safing slot, the material used for insulating may be of may be of a sound resistant and/or air tight material, such as an elastomeric interlaced foam based on synthetic rubber (e.g. Armaprotect® or Armaflex® from armacell®), a polyethylene foam, a polyurethane foam, a polypropylene foam or a polyvinyl chloride foam.

Before, installation in a safing slot of a curtain wall construction, the following steps should be carried out, which are considered as common general knowledge and are considered as reasonable to a skilled person in the art: In a first step, the width of the desired edge of slab curtain wall joint is measured. Subsequently, the measured joint width is used for determining which width of the tubular sealing element of the dynamic, thermally insulating and sealing system is suitable for the present joint width, wherein each design of a tubular sealing element has a predetermined joint width range per product. Following, the length of the curtain wall joint is measured. This length usually is taken between curtain wall anchors. In a next step, the length of the tubular sealing element of the dynamic, thermally insulating and sealing system is measured and cut if necessary to match the needed length. If necessary, the edge of the tubular sealing element is cut to match the profile of the bracket that the tubular sealing element will be installed against and the surface of curtain wall and slab is cleaned from dust, oil, debris, and water.

Then the tubular sealing element is installed to the process according to the present invention. In particular is placed on its long end and aligned on the edge of the slab. Subsequently, the tubular sealing element is slightly compressed and rolled 90 degrees over the edge of the slab into the curtain wall joint. Once the tubular sealing element is installed flush with the upper surface of the slab, the adhesive backers on the curtain wall tape are removed and the adhesive is bonded to the curtain wall façade. Next, the adhesive backer on the slab adhesive are removed and bonded to the slab edge. If additional pieces of the tubular sealing element of the dynamic, thermally insulating and sealing system are needed previously disclosed steps have to be repeated for the additional pieces. Finally, each seam, splice or butt joint between adjacent tubular sealing elements and around each bracket might be sealed be applying a watertight seal just in this location to enhances the water-stopping properties of the dynamic, thermally insulating and sealing system. In particular, the watertight seal can be applied with a 2 mm wet thickness over any seams and overlapping a min. of 1 inch onto tubular sealing elements, the adjacent curtain wall assembly and concrete floor slab assembly. There is no need for applying the sealant across the whole safing slot area. Preferably, the watertight seal is in the form of an emulsion, spray, coating, foam, paint or mastic.

In other words, the tubular sealing element is continuously installed with an approximately 10% to 40% compression into the safing slot with side surface positioned in abutment with respect to the outer edge of the floor and in abutment with respect to the interior wall surface of the curtain wall construction, respectively, and with its top side cover preferably being flush to the upper surface of the floor. When installing, one or more tubular sealing elements are compressed to varying degrees, but normally compressed to approximately 10% to 40%. This compression will cause exertion of a force outwardly in order to expand outwardly to fill voids created in the safing slot. The first connection area of the tubular sealing element is attached to the interior wall surface of the curtain wall construction, wherein the first connection area is arranged essentially vertical, protruding upwardly from the tubular sealing element, and parallel to the interior wall surface of the curtain wall construction. The second connection area of the tubular sealing element is attached the upper surface of the floor, wherein the second connection area is arranged essentially horizontal, protruding outwardly from the tubular sealing element, and parallel to the upper surface of the floor making a flush connection between the top side cover and the edge of the floor.

While the invention is particularly pointed out and distinctly described herein, a preferred embodiment is set forth in the following detailed description, which may be best understood when read in connection with the accompanying drawing.

In the FIGURE a side cross-sectional view of the fire-, smoke-, sound- and/or water-proof system in its final installation within an exterior dynamic curtain wall façade is shown, wherein the vision glass extends to the finished floor level below. In particular, the fire-, smoke-, sound- and/or water-proof system 100 is initially installed in the area of a zero spandrel area of a glass curtain wall construction, defined by an interior wall surface 1 including one or more framing members, i.e., vertical framing member—mullion 2—and horizontal framing member—transom 3—which is located at the floor level, and at least one floor 4 spatially disposed from the interior wall surface 1 of the curtain wall construction defining a safing slot 5 extending between the interior wall surface 1 of the curtain wall construction and an outer edge 6 of the floor 4. The framing members 2 and 3 are infilled with vision glass 7 extending to the finished floor level below. The fire-, smoke-, sound- and/or water-proof system 100 has a tubular sealing element 8 comprising a top side cover 9 and a bottom side cover 10 which together surround a thermally resistant flexible foam material 11. The foam material is an intumescent foam material on a polyurethane base with a certain percentage of fire-protective additive materials, preferably blowing graphite. During an event of a fire, the intumescent materials will create an ash crust which will provide the fire protective function. The foam composition can be adjusted i.e. density, firestop filler percentage, etc. so that the necessary fire protective function is provided to the safing slot. Preferably, the tubular sealing element 8 has an approximately rectangular cross section with an upper surface 12, a lower surface 13 being arranged approximately in parallel to each other and a first side surface 14 and a second side surface 15 being arranged approximately in parallel to each other. Preferably, the top side cover 9 is a top side laminate 9, which builds the upper surface 12, whereas the bottom side cover 10 preferably is a bottom side laminate 10, which builds the lower surface 13 and both side surfaces 14 and 15. The thermally resistant flexible foam material 11 is enclosed from the top side cover 9 and the bottom side cover 10, wherein the thermally resistant flexible foam material 11 is connected to inner surfaces of the top side cover 9 and of the bottom side cover 10. When mounted, the first side surface 14 of the tubular sealing element 8 is adjacent to the outer edge 6 of the floor 4 and the second side surface 15 is adjacent to the interior wall surface 1 of the curtain wall construction preferably adjacent to the insulation positioned in a zero-spandrel area 17 of the curtain wall construction. The upper surface 12 of the mounted tubular sealing element 8 is flush with the upper surface 18 of the floor 4. In the present embodiment the tubular sealing element 8 has a smaller height than the floor 4, wherein the height of the tubular sealing element 8 is preferably about half of the height of the floor 4.

It should be appreciated that these embodiments of the present invention will work with minor modifications, as each curtain wall manufacturer/constructor has its own architectural design, which requires minor adjustments to the construction process. These include but are not limited to the water-tight gaskets, anchor bracket attachment method, and mullion/transom design.

The installed fire-, smoke-, sound- and/or water-proof system achieved and an F-Rating of 120 min as well as a movement rating of class IV.

It has been shown that the installed fire-, smoke-, sound- and/or water-proof system within a stick build exterior dynamic curtain wall façade or in a curtain wall assembly from unitized panels of the present invention, maintains sealing of the safing slots surrounding the floor of each level in a building.

In particular, it has been demonstrated that the installed fire-, smoke-, sound- and/or water-proof system within an exterior dynamic curtain wall façade of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining safing insulation between the floors of a residential or commercial building and the exterior curtain wall responsive to various conditions including fire exposure is guaranteed.

Further, it has been shown, that the installed fire-, smoke-, sound- and/or water-proof system meets the requirements of a full-scale ASTM E 2307 as well as full-scale ASTM E 1399 tested system for floor assemblies, in particular for floor assemblies where the vision glass extends to the finished floor level, addressing the code exception, avoiding letters and engineering judgments and securing and providing defined/tested architectural detail for this application, in particular providing a tested system for fire- and movement-safe architectural compartmentation.

A great advantage of the installed fireproof system within an exterior dynamic curtain wall assembly of the present invention is that no mineral wool is used which may absorb water.

It has been shown that the process for installing the fire-, smoke-, sound- and/or water-proof system makes it easier for the installers to build up the curtain wall on the jobsite, in particular because it can be installed from one side, implementing a one-sided application.

Further, the fire-, smoke-, sound- and/or water-proof system can be easily mounted with a low compression in different sizes of safing slots as it is provided in different sizes, nevertheless providing optimal fire resistance.

Further, a process is provided that results in a system that has improved fire-resistance as well as sound-resistance, and has at the same time enhanced water-stopping properties and can be easily integrated during installation of the curtain wall structure. Further, the installed system additionally addresses water infiltration as well as inhibition of water transfer within the building structures and enhancement of water-tightness of the safing slot sealing system.

While particular embodiments of this invention have been shown in the drawings and described above, it will be apparent that changes may be made in the form, arrangement and positioning of the tubular sealing element. In consideration thereof, it should be understood that preferred embodiments of this invention disclosed herein are intended to be illustrative only and not intended to limit the scope of the invention.

The invention claimed is:

1. A process for assembling a fire-, smoke-, sound- and/or water-proof system in a curtain wail assembly, the process comprising:

positioning a tubular sealing element in a safing slot between an interior wall surface of a curtain wall façade and an outer edge of a floor of a building structure, wherein the tubular sealing element comprises a thermally resistant flexible foam material, a bottom side cover, a top side cover, a first connection area, and a second connection area spatially disposed from the first connection area; and fixing the first connection area to the interior wall surface of the curtain wall façade and fixing the second connection area to the floor of the building structure, thereby sealing the safing slot, wherein the bottom side cover and the top side cover are connected at the first connection area and the second connection area spatially disposed from the first connection area, thereby surrounding the thermally resistant flexible foam material, wherein fixing the first connection area comprises fixing a lower side of the first connection area to the interior wall surface of the curtain wall façade, and wherein fixing the second connection area comprises fixing a lower side of the second connection area to a top surface of the floor, wherein fixing the first connection area and the second connection area of the tubular sealing element comprises fixing using an adhesive layer including at least one adhesive backer.

2. The process according to claim 1, wherein, after positioning the tubular sealing element in the safing slot, a first side surface of the bottom side cover abuts the outer edge of the floor, and a second side surface of the bottom side cover abuts the interior wall surface.

3. The process according to claim 2, wherein the tubular sealing element in an installed state has a compression of about 10% to 40% with respect to the tubular sealing element in an uninstalled state.

4. The process according to claim 1, wherein positioning the tubular sealing element comprises placing the tubular sealing element into the safing slot such that the top side cover is flush with a top surface of the floor.

5. The process according to claim 1, further comprising applying a watertight seal at at least one seam, splice or butt joint between adjacent tubular sealing elements and/or around a bracket.

6. The process according to claim 5, wherein the watertight seal is an emulsion, spray, coating, foam, paint, or mastic.

7. The process according to claim 1, further comprising installing an architectural cover, a steel plate, or a kneewall.

8. The process according to claim 1, wherein:

the tubular sealing element has a width of about 3.54 inches and the safing slot has a width of 1.5 inches to 3 inches;

the tubular sealing element has a width of about 4.53 inches and the safing slot has a width of 2 inches to 4 inches; or the tubular sealing element has a width of about 5.55 inches and the safing slot has a width of 3 inches to 5 inches.

9. The process according to claim 1, wherein the thermally resistant flexible foam material is an intumescent, open-celled foam material comprising a fire-protective additive.

10. The process according to claim 9, wherein the flexible foam material is hydrophobic.

11. The process according to claim 1, further comprising, before positioning the tubular sealing element, cutting at least the thermally resistant flexible foam material, the bottom side cover, and the top side cover of the tubular sealing element to a length of the safing slot.

12. The process according to claim 1, wherein positioning the tubular sealing element in the safing slot comprises:

aligning a long end of the tubular sealing element on an edge of the floor, and compressing the tubular sealing element and rolling the tubular sealing element over the edge of the floor and into the safing slot.

13. A building construction having a curtain wall construction defined by an interior wall surface including one or more framing members and at least one floor spatially disposed from the interior wall surface of the curtain wall construction defining the safing slot extending between the interior wall surface of the curtain wall construction and an outer edge of the floor, comprising a fire-, smoke-, sound- and/or water-proof system installed according to the process of claim 1.

14. A process for assembling a fire-, smoke-, sound- and/or water-proof system in a curtain wall assembly, the process comprising:

positioning a tubular sealing element in a safing slot between an interior wall surface of a curtain all façade and an outer edge of a floor of a building structure, wherein the tubular sealing element comprises a thermally resistant flexible foam material, a bottom side cover, a top side cover, a first connection area, and a second connection area spatially disposed from the first connection area; and fixing the first connection area to the interior wall surface of the curtain wall façade and fixing the second connection area to the floor of the building structure, thereby sealing the safing slot, wherein the bottom side cover and the top side cover are connected at the first connection area and the second connection area spatially disposed from the first connection area, thereby surrounding the thermally resistant flexible foam material, wherein fixing the first connection area to the interior wall surface comprises removing an adhesive backer from a first adhesive layer on a lower side of the first connection area and bonding the first adhesive layer to the interior wall surface, and wherein fixing the second connection area to the floor comprises removing an adhesive backer from a second adhesive layer on a lower side of the second connection area and bonding the second adhesive layer to a top surface of the floor.

15. A process for assembling a fire-, smoke-, sound- and/or water-proof system in a curtain wall assembly, the process comprising:

positioning a tubular sealing element in a safing slot between an interior wall surface of a curtain wall façade and an outer edge of a floor of a building structure, wherein the tubular sealing element comprises a thermally resistant flexible foam material, a bottom side cover, a top side cover, a first connection area, and a second connection area spatially disposed from the first connection area; and fixing the first connection area to the interior wall surface of the curtain wall façade and fixing the second connection area to the floor of the building structure, thereby sealing the safing slot, wherein the bottom side cover and the top side cover are connected at the first connection area and the second connection area spatially disposed from the first connection area, thereby surrounding the thermally resistant flexible foam material, wherein sealant is applied over a portion of the length of the safing slot.

* * * * *